US012751557B2

(12) United States Patent
Huang et al.

(10) Patent No.: US 12,751,557 B2
(45) Date of Patent: Oct. 6, 2026

(54) EXPANDABLE AND VARIED FURNITURE STRUCTURE

(71) Applicant: Home Creations Inc., Shanghai (CN)

(72) Inventors: Yuan Huang, Shanghai (CN); Chun-Sheng Cheng, Shanghai (CN)

(73) Assignee: HOME CREATIONS INC., Shanghai (CN)

( * ) Notice: Subject to any disclaimer, the term of this patent is extended or adjusted under 35 U.S.C. 154(b) by 160 days.

(21) Appl. No.: 18/640,119

(22) Filed: Apr. 19, 2024

(65) Prior Publication Data

US 2025/0325112 A1 Oct. 23, 2025

(51) Int. Cl.

| | |
|---|---|
| ***A47C 13/00*** | (2006.01) |
| ***A47C 7/02*** | (2006.01) |
| ***A47C 7/42*** | (2006.01) |
| ***A47C 7/54*** | (2006.01) |

(52) U.S. Cl.

CPC ..... *A47C 13/005* (2013.01); *A47C 7/021* (2013.01); *A47C 7/42* (2013.01); *A47C 7/546* (2013.01)

(58) Field of Classification Search

CPC ..... A47C 13/005; A47C 7/02; A47C 7/021; A47C 7/42; A47C 7/546

See application file for complete search history.

(56) References Cited

U.S. PATENT DOCUMENTS

| | | | | |
|---|---|---|---|---|
| 2012/0256464 | A1 | 10/2012 | Chang | |
| 2022/0354261 | A1* | 11/2022 | Aubé | A47C 13/005 |
| 2025/0067295 | A1* | 2/2025 | Lee | F16B 12/24 |

* cited by examiner

*Primary Examiner* — Justin Michael Heston
(74) *Attorney, Agent, or Firm* — MUNCY, GEISSLER, OLDS & LOWE, P.C.

(57) ABSTRACT

An expandable and varied furniture structure includes at least one base, at least one wall, and at least one auxiliary clip. The at least one wall selectively close to one of the plurality of sides, the at least one wall includes a plurality of connecting pieces, and each of the plurality of connecting pieces includes a pivot part, a connecting part connected to the pivot part, a step part connected to the connecting part, and a mounting part connected to the step part, the connecting part parallel to the mounting part, each of the plurality of connecting pieces penetrated in each of the plurality of connection ports by the mounting part thereof, and each of the plurality of connecting pieces stands on a side of the at least one base through at least one of the connecting part and the step part abutted against the at least one base.

8 Claims, 10 Drawing Sheets

EXPANDABLE AND VARIED FURNITURE STRUCTURE

FIELD OF THE INVENTION

The invention relates to a furniture structure, in particular a furniture structure, which can be rapidly expanded and varied.

BACKGROUND OF THE INVENTION

US2012/0256464 A1 discloses a modular furniture frame assembly. Although US2012/0256464 A1 discloses a modular structural design, the overall structure is limited to a single configuration, and cannot be expanded or changed. Specifically, when the aforementioned modular furniture frame assembly is designed as a multi-seat sofa, its structure is not allowed to vary and does not jump out of the design idea that the conventional furniture cannot be expanded. Furthermore, the modular furniture frame assembly is cumbersome and cannot be assembled quickly.

SUMMARY OF THE INVENTION

A main object of the invention is to solve a problem of limitation of imposed by convention implementation.

A secondary object of the invention is to solve a problem of inability of convention structures to be quickly assembled.

In order to achieve the above object, the invention provides an expandable and varied furniture structure, including at least one base, at least one wall, and at least one auxiliary clip. The at least one base includes a plurality of connection ports on a plurality of sides. The at least one wall is selectively close to one of the plurality of sides, the at least one wall includes a plurality of connecting pieces, each of the plurality of connecting pieces comprising a pivot part, a connecting part connected to the pivot part, a step part connected to the connecting part, and a mounting part connected to the step part, the connecting part parallel to the mounting part, each of the plurality of connecting pieces penetrated in each of the plurality of connection ports by the mounting part thereof, and each of the plurality of connecting pieces standing on a side of the at least one base through at least one of the connecting part and the step part abutted against the at least one base. The at least one auxiliary clip connects a bottom of the at least one base to a bottom of the at least one wall.

In an embodiment, the plurality of sides formed with the plurality of connection ports are equal in number to the plurality of connecting pieces of the at least one wall.

In an embodiment, the at least one base comprises a bottom frame, a top frame, and a plurality of support posts connected to the bottom frame and the top frame, the plurality of connection ports are located on the top frame, and the at least one auxiliary clip is connected to the bottom frame.

In an embodiment, the top frame comprises a plurality of plates used to form one of the plurality of connecting ports, and the mounting part of each of the plurality of connecting pieces and the connecting part are respectively connected to two opposite faces of one of the plurality of plates.

In an embodiment, the at least one wall comprises an opening and a beam located in the opening and provided for disposal of the plurality of connecting pieces thereon.

In an embodiment, the beam comprises a plurality of pivot seats respectively assembled with one of the plurality of connecting pieces, and the plurality of pivot seats are located on a surface of the beam in pairs and spaced apart.

In an embodiment, the at least one base comprises a plurality of first feet, and the at least one wall comprises a plurality of second feet.

Through the aforementioned implementation of the invention, the invention has the following characteristics compared with the prior art:

The furniture structure of the invention can be expanded and varied to a desired configuration by adjusting a quantity of the at least one base and a quantity of the at least one wall, so that the furniture structure is no longer implemented in a single configuration. In addition to the foregoing, the invention provides a design by assembling the plurality of connecting pieces and the plurality of connection ports, which can greatly simplify an assembly process on a basis of a stable structure.

DETAILED DESCRIPTION OF THE PREFERRED EMBODIMENTS

Figure 1:
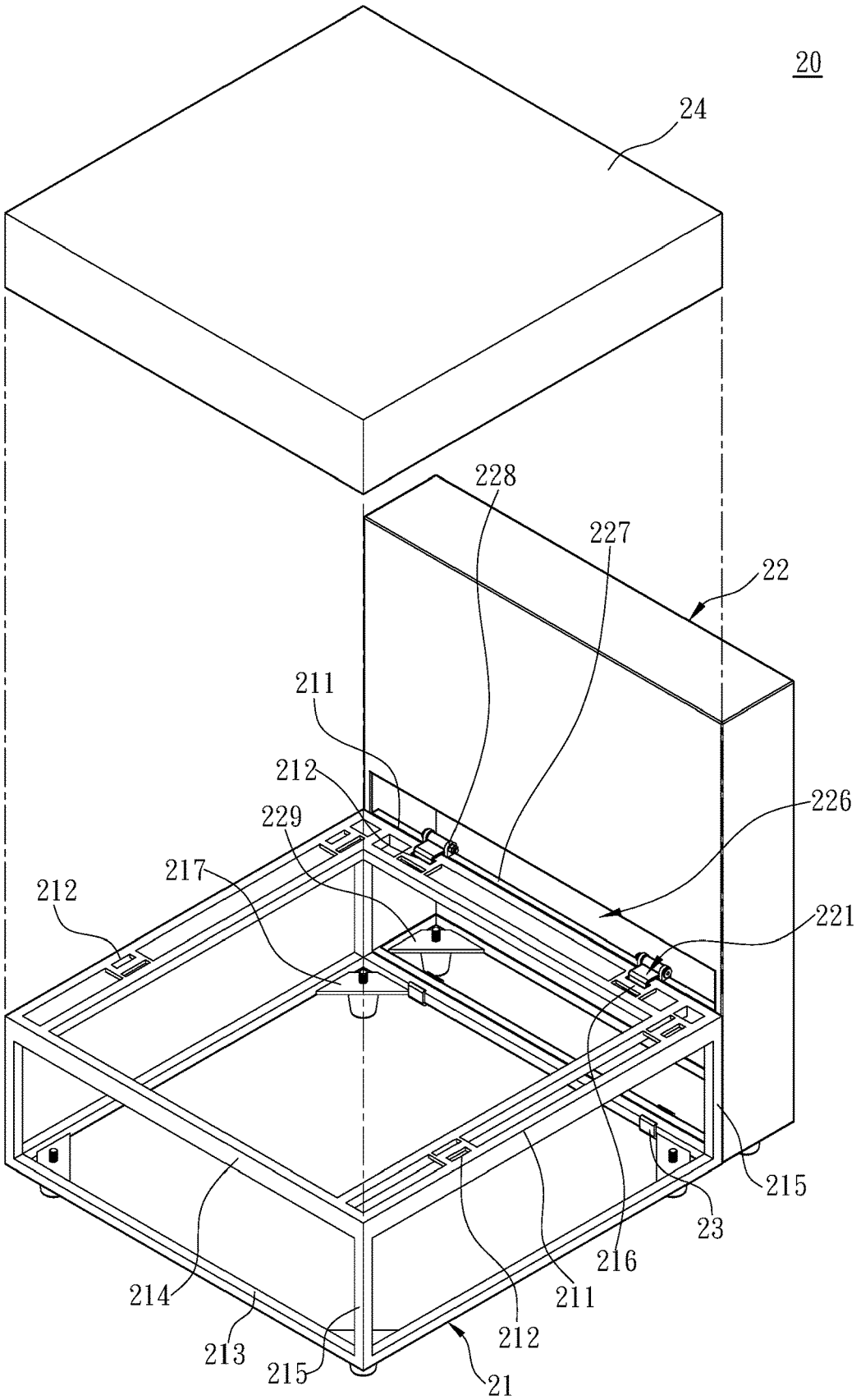
FIG. 1 is a perspective structural view of a first embodiment of a furniture structure of the invention.

The detailed description and technical content of the invention are described below with reference to the accompanying drawings.

Please refer to FIG. 1, FIG. 2, FIG. 3, FIG. 4, and FIG. 5. The invention provides a furniture structure 20 that is expandable and variable, and the furniture structure 20 is primarily used as a sofa or the like to provide sitting and resting. The furniture structure 20 can further be used as outdoor furniture based on a selected fabric, such as rattan. The furniture structure 20 includes at least one base 21, at least one wall 22, and at least one auxiliary clip 23. The at least one base 21 includes a plurality of connection ports 212 on a plurality of sides 211. The at least one wall 22 is selectively close to one of the plurality of sides 211, and the at least one wall 22 includes a plurality of connecting pieces 221. Each of the plurality of connecting pieces 221 includes a pivot part 222, a connecting part 223, a step part 224, and a mounting part 225. The pivot part 222 makes one of the plurality of connecting pieces 221 rotate to a certain extent, and the connecting part 223 is connected to the pivot part 222, and the step part 224 is connected to the connecting part 223, and the mounting part 225 is connected to the step part 224. The connecting part 223 is parallel to the mounting part 225. In an embodiment, the connecting part 223 and the mounting part 225 are both in a shape of a flat plate. When the connecting part 223 rotates one of the plurality of connecting pieces 221 in parallel, a horizontal height of the connecting part 223 is higher than that of the mounting part 225.

Figure 4:
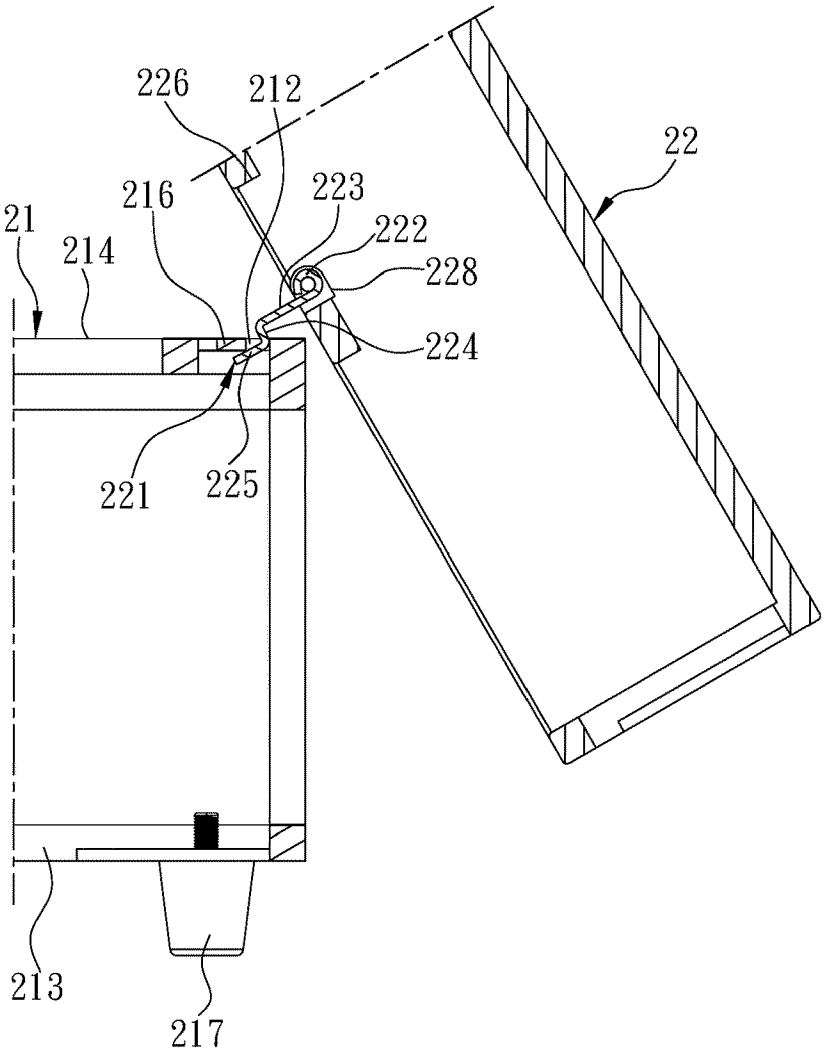
FIG. 4 is a first schematic diagram of a structural assembly of the first embodiment of the furniture structure.
Figure 5:
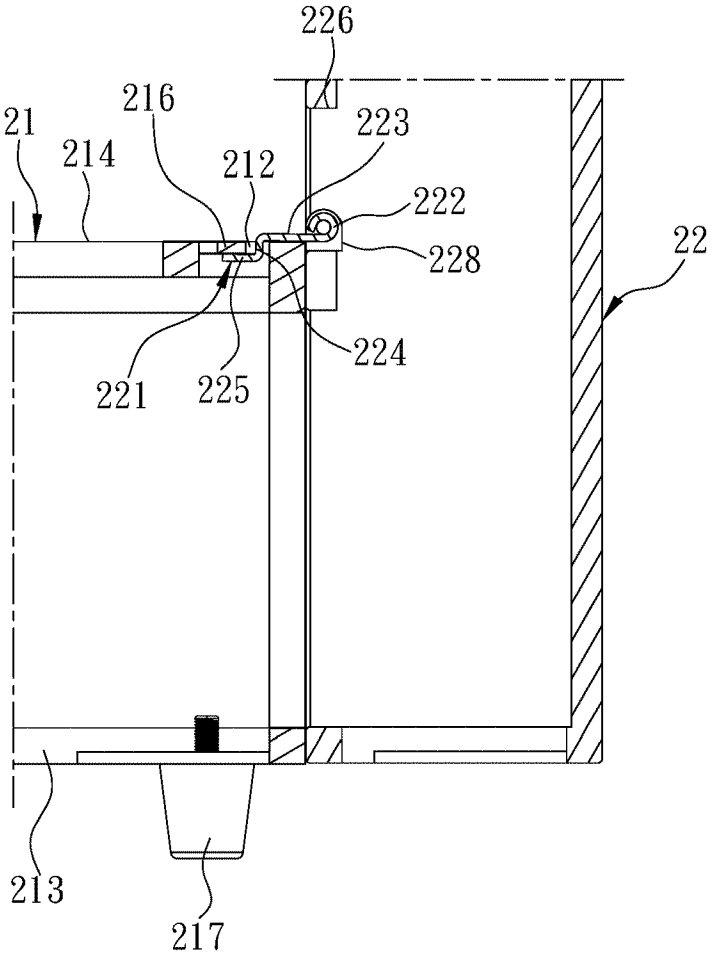
FIG. 5 is a second schematic diagram of the structural assembly of the first embodiment of the furniture structure.

Please refer to FIG. 1, FIG. 4, and FIG. 5. To illustrate an assembly of the furniture structure of the invention, a back chair for a single person is used as an example herein. In this example, a quantity of the at least one base 21 is one, and a quantity of the at least one wall 22 is one. At initial assembly, the wall 22 is close to one of the plurality of sides 211 of the base 21, and the wall 22 is tilted to make each of the plurality of connecting pieces 221 corresponds to one of the plurality of connection ports 212, respectively. Each of the plurality of connecting pieces 221 is penetrated in each of the plurality of connection ports 212 by the mounting part 225 thereof, and then the wall 22 is returned to be upright so that each of the plurality of connecting pieces 221 stands on a side of the base 21 through at least one of the connecting part 223 and the step part 224 abutted against the at least one base 21. After that, a bottom of the base 21 is connected to a bottom of the wall 22 adjacent by the at least one auxiliary clip 23. In another embodiment, when a plurality of bases 21 are connected, a plurality of auxiliary clips 23 are also used for connecting the plurality of bases 21.

Figure 6:
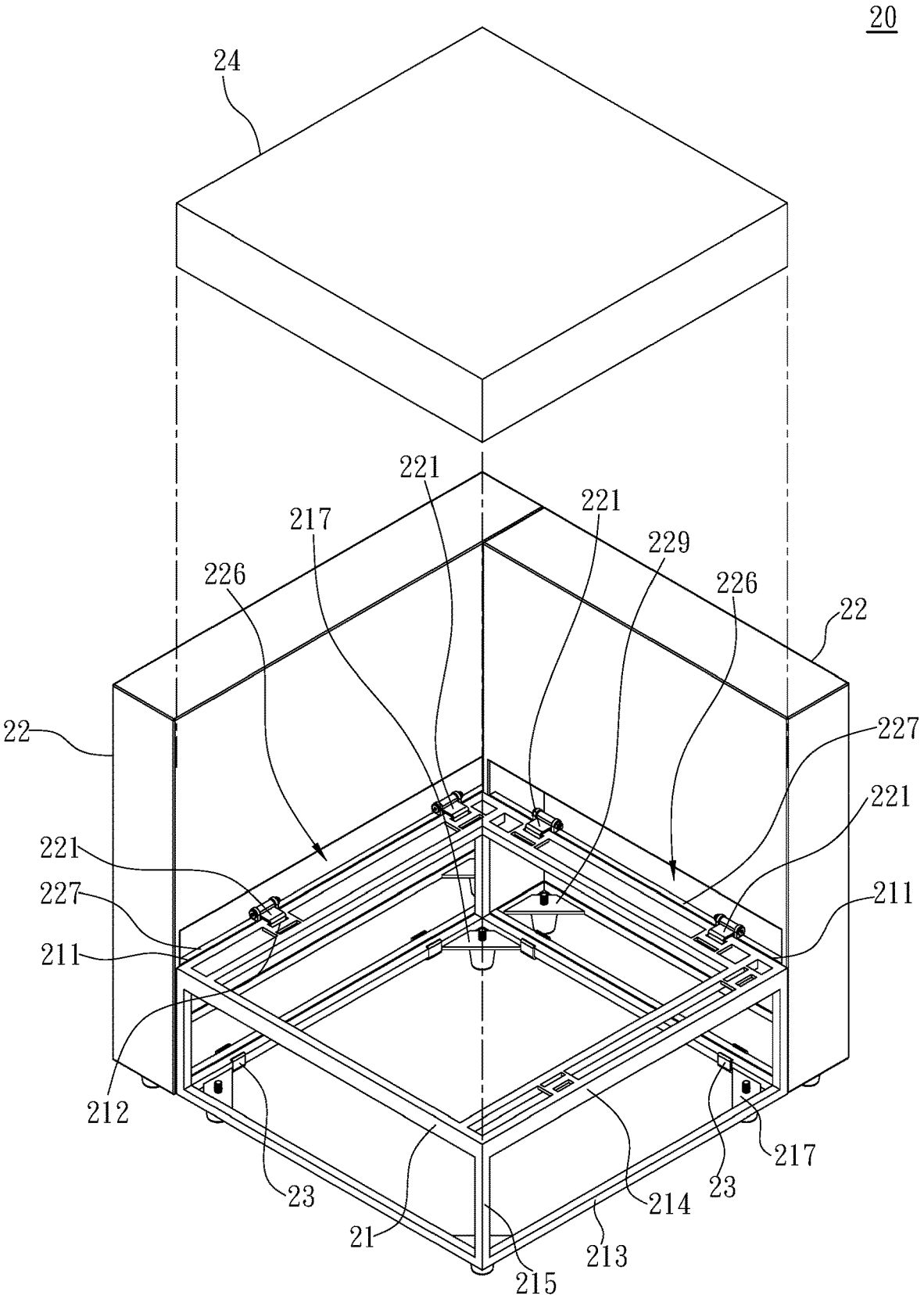
FIG. 6 is a perspective structural view of a second embodiment of the furniture structure of the invention.
Figure 7:
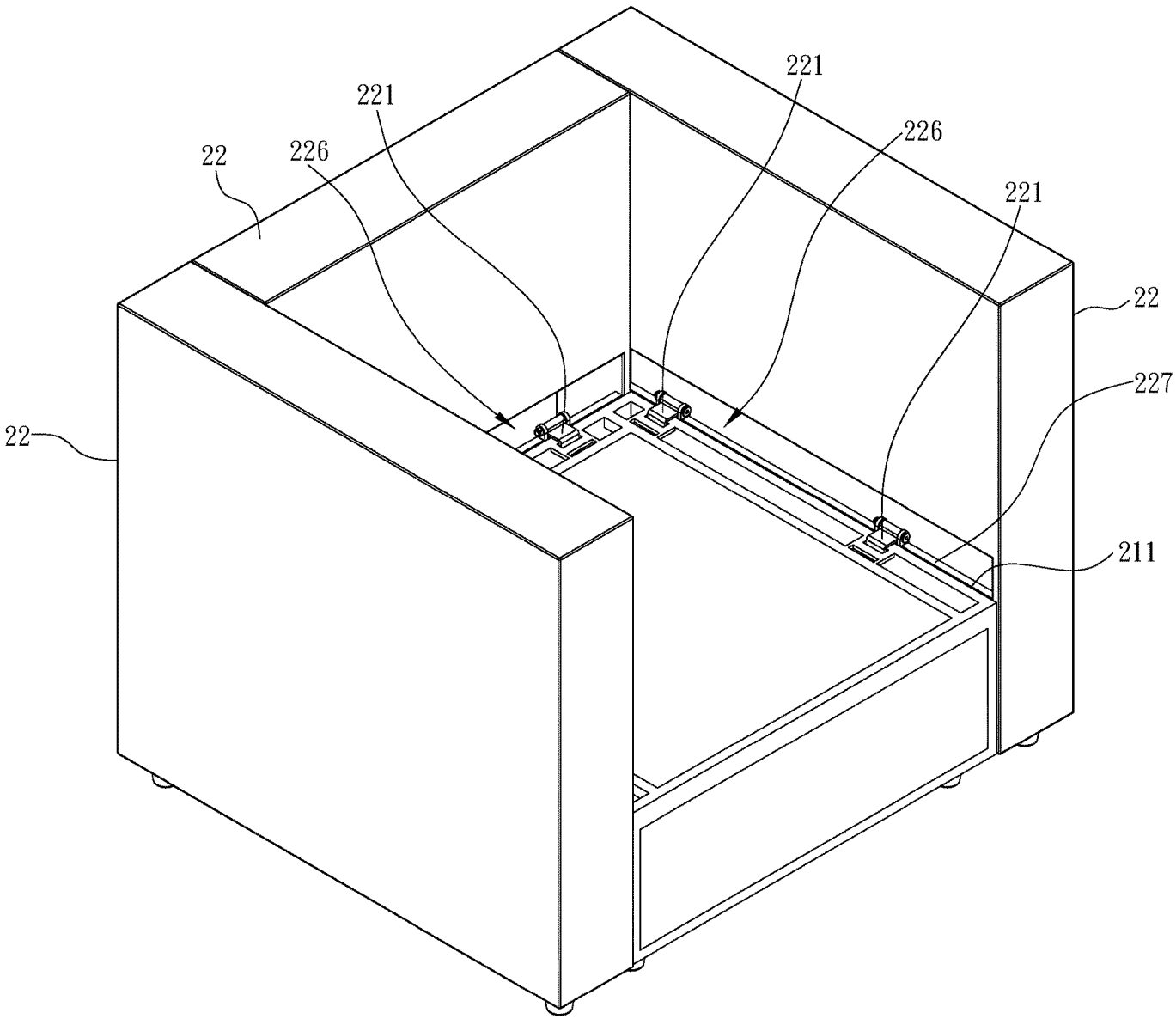
FIG. 7 is a perspective structural view of a third embodiment of the furniture structure of the invention.
Figure 8:
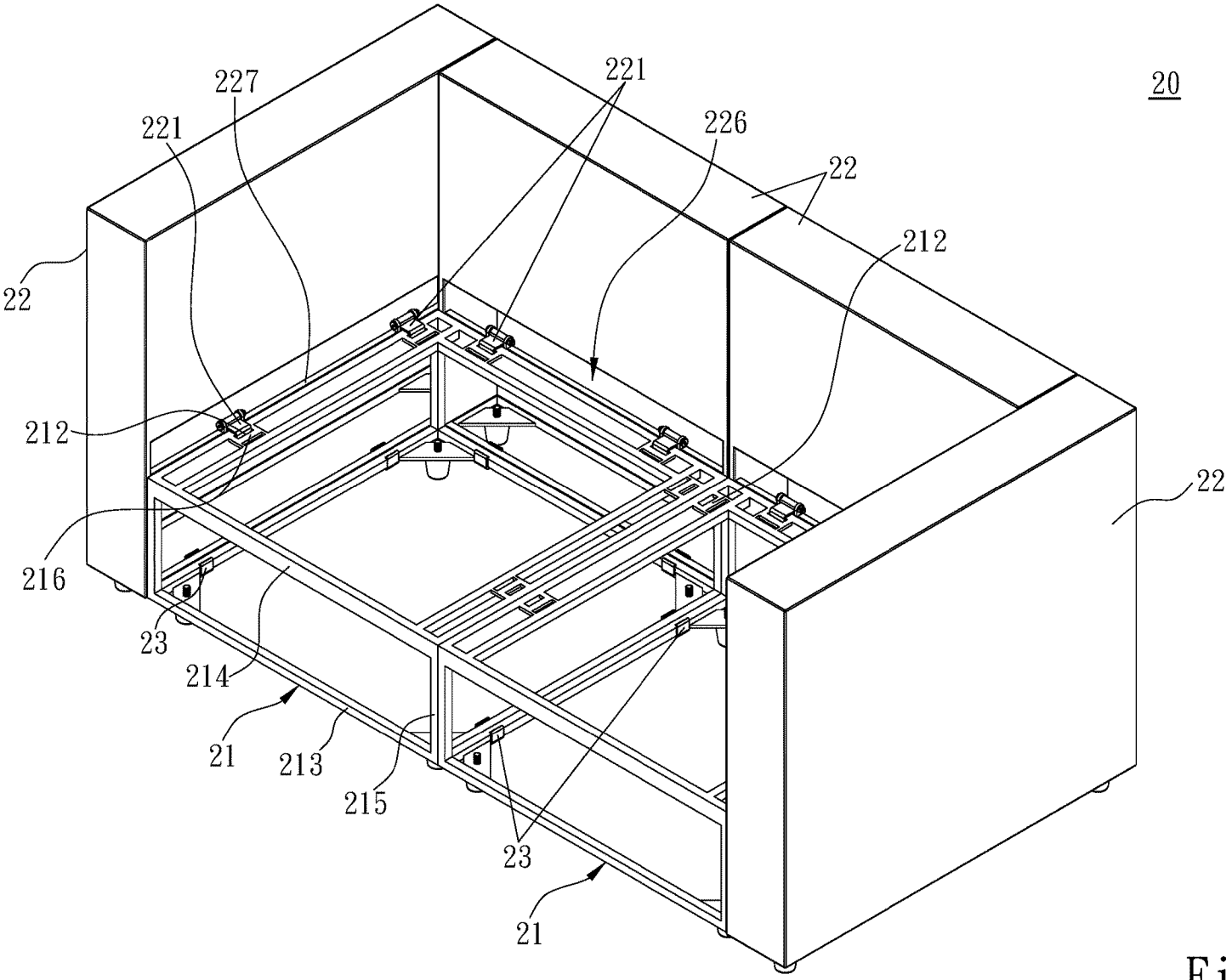
FIG. 8 is a perspective structural view of a fourth embodiment of the furniture structure of the invention.
Figure 9:
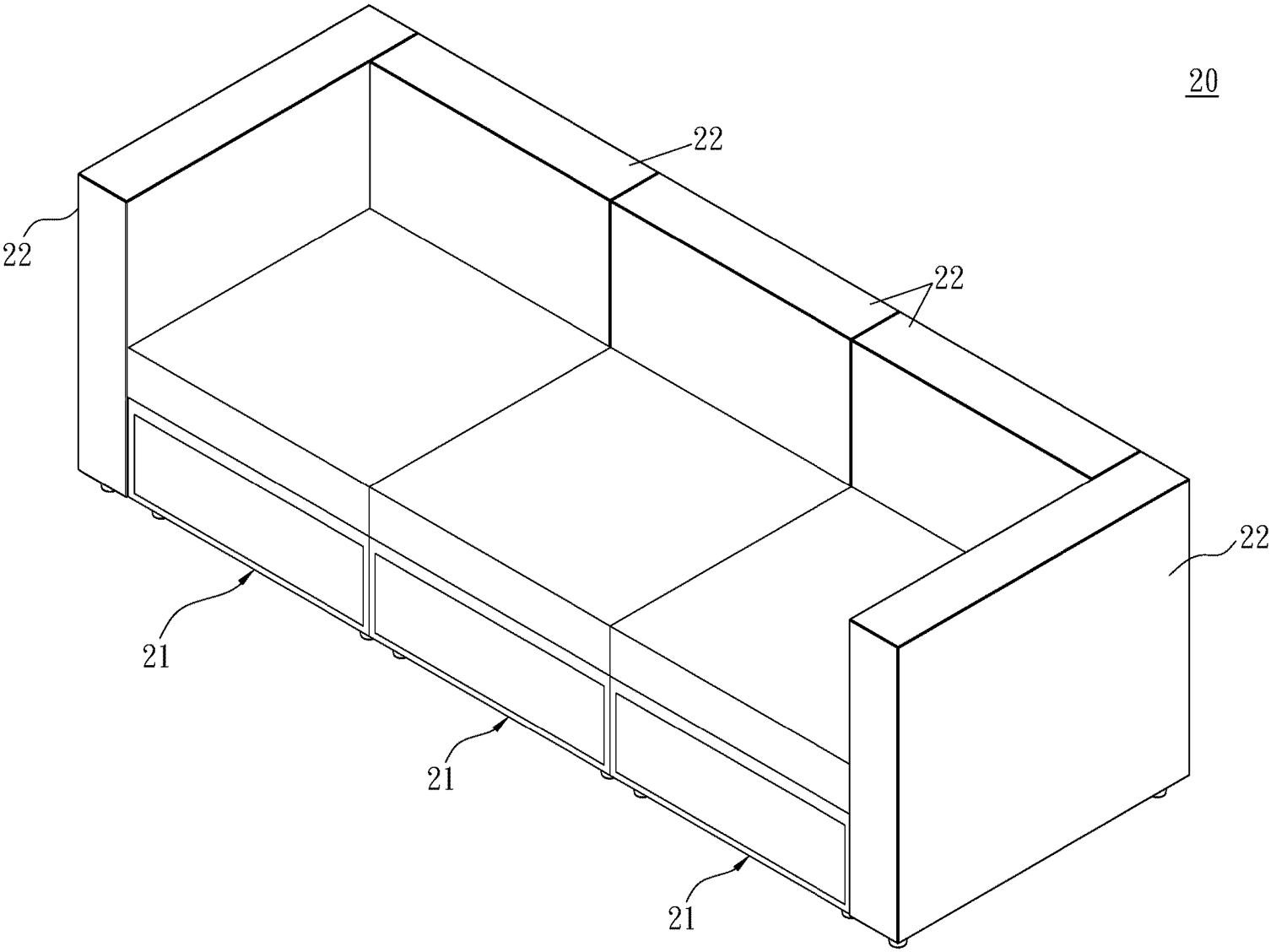
FIG. 9 is a perspective structural view of a fifth embodiment of the furniture structure of the invention.
Figure 10:
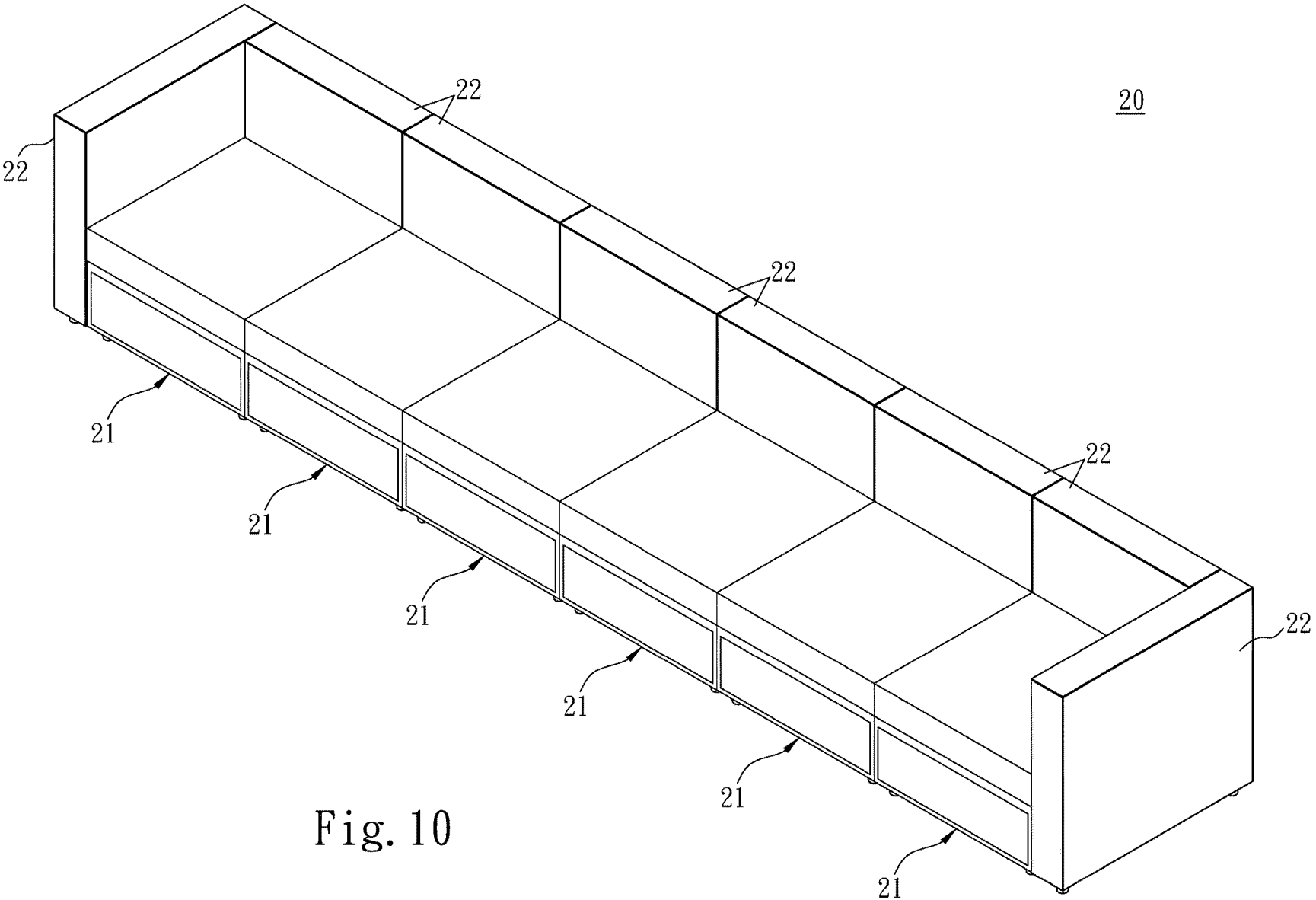
FIG. 10 is a perspective structural view of a sixth embodiment of the furniture structure of the invention.
Figure 11:
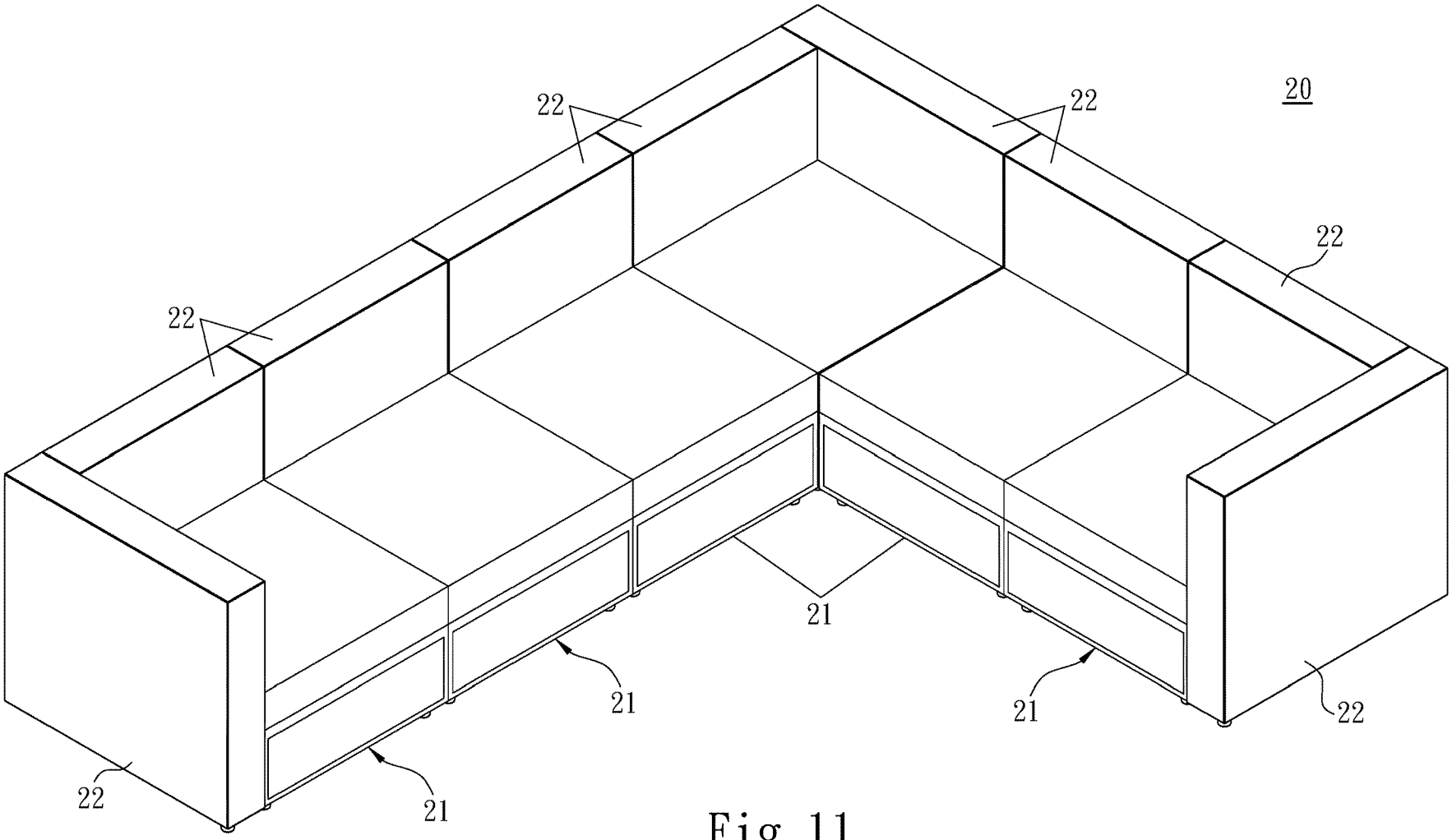
FIG. 11 is a perspective structural view of a seventh embodiment of the furniture structure of the invention.

The quantity of the at least one base 21 and the quantity of the at least one wall 22 of the furniture structure 20 can be adjusted in the invention to meet implementation requirements. Please refer to FIG. 6, in one embodiment, the quantity of the at least one base 21 is one, and the quantity of the at least one wall 22 is two, and the furniture structure 20 is implemented in a form of a corner chair. Please refer to FIG. 7, in another embodiment, the quantity of the at least one base 21 is one, and the quantity of the at least one wall 22 is three, and the furniture structure 20 is implemented in a form of a single-seat sofa. Please refer to FIG. 8, in another embodiment, the quantity of the at least one base 21 is two, and the quantity of the at least one wall 22 is four, and the furniture structure 20 is implemented in a form of a multi-seat sofa, as shown in FIG. 9 and FIG. 10. Further, in addition to the single-row sofa configuration, the furniture structure 20 of the invention can be expanded in a form of an L-shaped sofa, as shown in FIG. 11. It can be understood from the foregoing, the furniture structure 20 of the invention can be expanded and varied to a desired configuration based on implementation requirements, a removed portion of the at least one base 21 and a removed portion of the at least one wall can be stowed when an implementation requirement is changed. The invention significantly improves a problem of current furniture that cannot be expandable and varied, and avoids bulky garbage generated by discarding large furniture to a certain extent.

In addition to the above, the invention provides a design by assembling the plurality of connecting pieces 221 and the plurality of connection ports 212, which can greatly simplify an assembly process on a basis of a stable structure.

Figure 2:
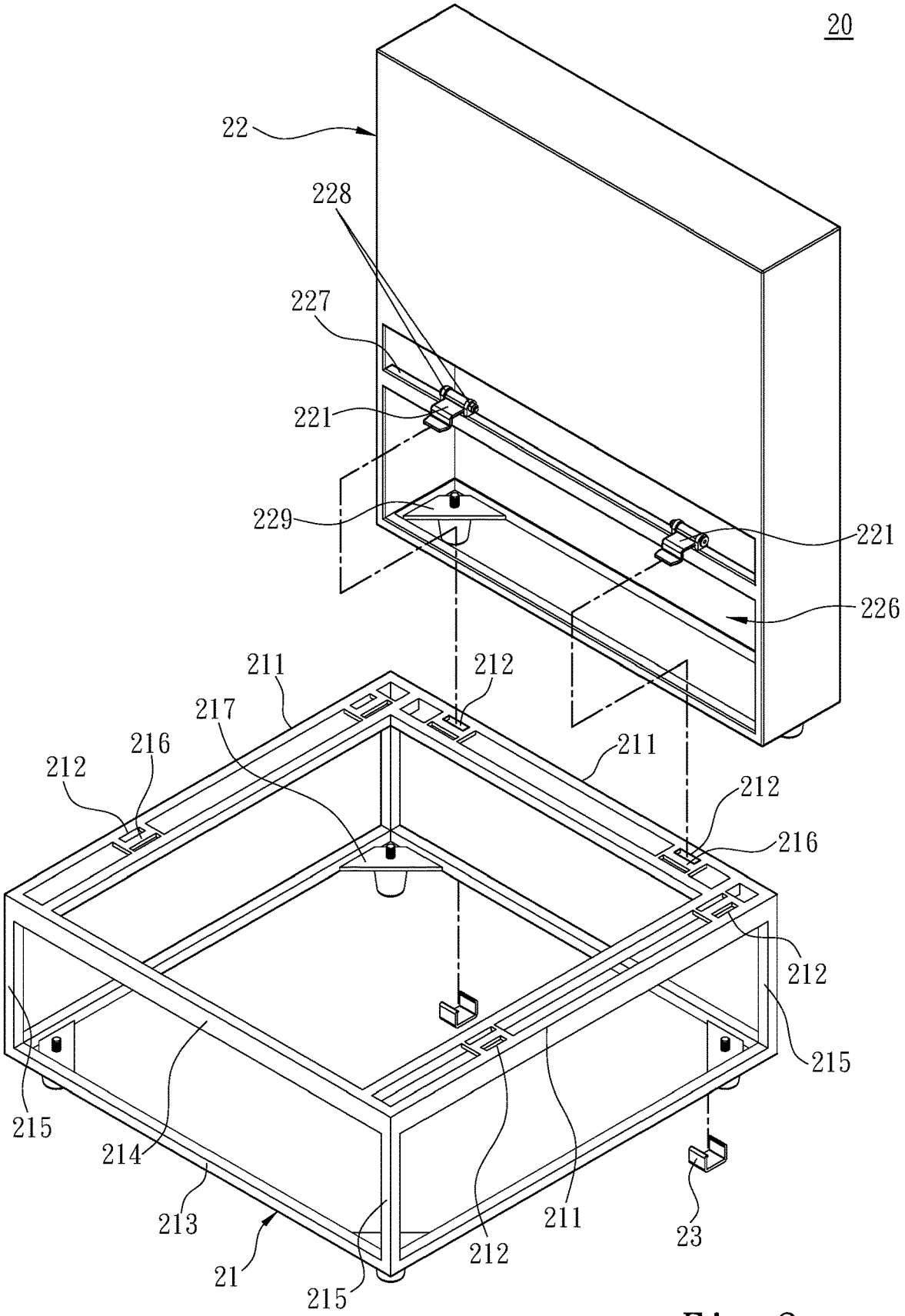
FIG. 2 is a perspective structural view of the first embodiment of the furniture structure of the invention.

Please refer to FIG. 2, in an embodiment, each of the plurality of sides 211 formed with the plurality of connection ports 212 is equal in number to the plurality of connecting pieces 221 of the at least one wall 22.

Figure 3:
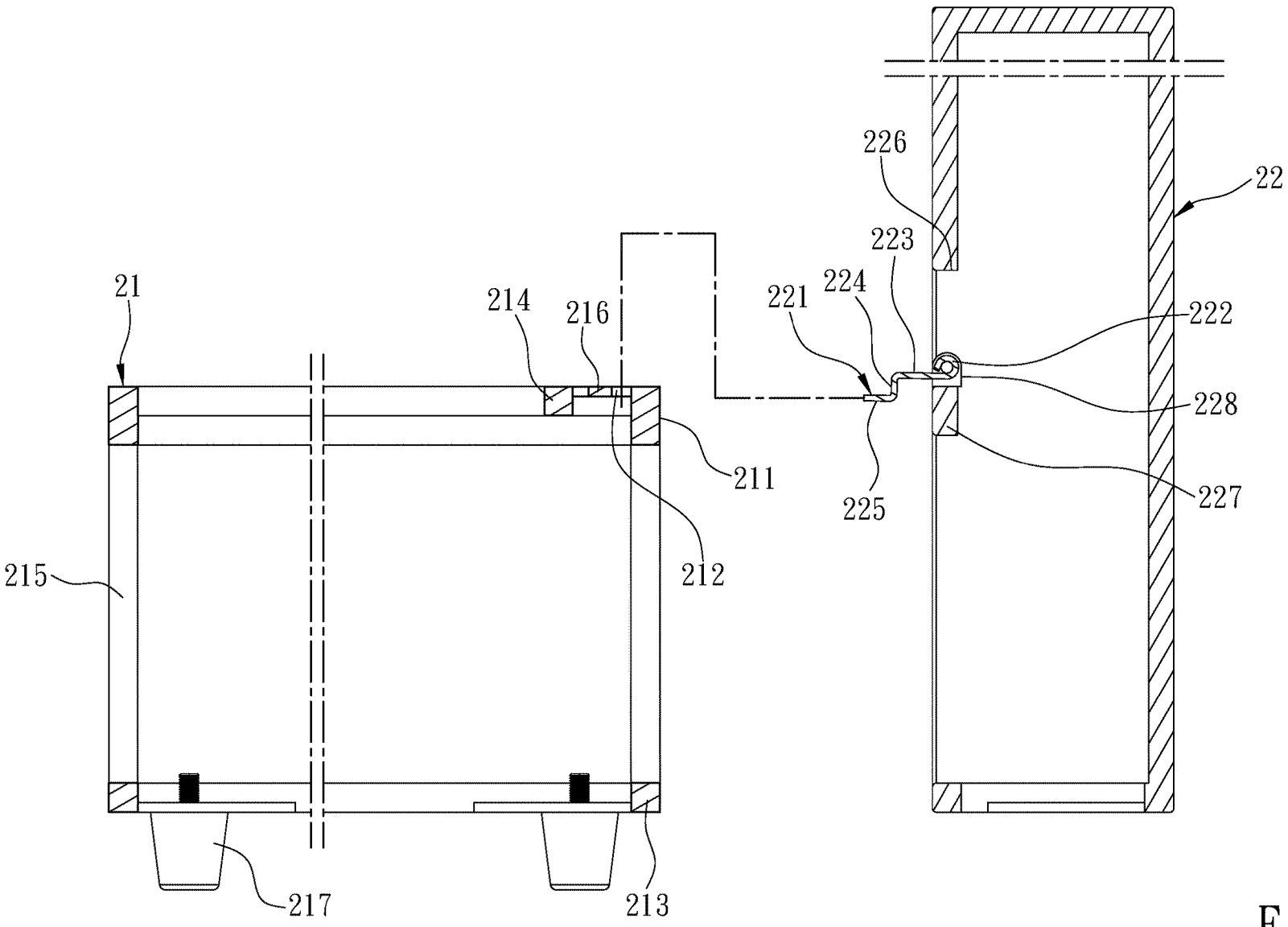
FIG. 3 is a cross-section view of the first embodiment of the invention.

Please refer to FIG. 2 and FIG. 3, in an embodiment, the at least one base 21 includes a bottom frame 213, a top frame 214, and a plurality of support posts 215. The bottom frame 213 is disposed in parallel with the top frame 214, and the plurality of support posts 215 are connected to the bottom frame 213 and the top frame 214. The plurality of connection ports 212 are located on the top frame 214, and the at least one auxiliary clip 23 is connected to the bottom frame 213. In an embodiment, the top frame 214 includes a plurality of plates 216, each of the plurality of plates 216 is used to form one of the plurality of connecting ports 212. In an embodiment, after the at least one wall 22 is assembled with the at least one base 21, the mounting part 225 of each of the plurality of connecting pieces 221 and the connecting part 223 are respectively connected to two opposite faces of one of the plurality of plates 216.

Please refer to FIG. 1, FIG. 2, FIG. 3, FIG. 4, and FIG. 5. In an embodiment, the at least one wall 22 includes an opening 226 and a beam 227. The opening 226 is formed in a portion of the at least one wall 22 where a fabric is not used, and the opening 226 is formed in a position close to the bottom of the at least one wall 22. The beam 227 is located in the opening 226 and provided for disposal of the plurality of connecting pieces 221 thereon. Further, in an embodiment, the beam 227 includes a plurality of pivot seats 228 respectively assembled with one of the plurality of connecting pieces 221, and the plurality of pivot seats 228 are implemented in pairs and are spaced apart, and the plurality of pivot seats 228 are located on a surface of the beam 227.

Please refer to FIG. 1, in an embodiment, the at least one base 21 includes a plurality of first feet 217, and the at least one wall 22 includes a plurality of second feet 229. The plurality of first feet 217 support the at least one base 21 to have a height from a ground to a bottom face of the at least one base 21, and the plurality of second feet 229 support the at least one wall 22 to have a height from the ground to a bottom face of the at least one wall 22. The plurality of first feet 217 are respectively located at a corner of the at least one base 21, and the plurality of second feet 229 are respectively located at a corner of the at least one wall 22.

Please refer to FIG. 1, in an embodiment, the furniture structure 20 further includes at least one seat cushion 24 stacked on the at least one base 21. The at least one seat cushion 24 is equal in number to the at least one base 21. A material of the at least one seat cushion 24 may be selected according to using requirements, and is not limited therein.

What is claimed is:

1. An expandable and varied furniture structure, comprising:

at least one base, comprising a plurality of connection ports on a plurality of sides;

at least one wall, selectively close to one of the plurality of sides, the at least one wall comprising a plurality of connecting pieces, each of the plurality of connecting pieces comprising a pivot part, a connecting part connected to the pivot part, a step part connected to the connecting part, and a mounting part connected to the step part, the connecting part parallel to the mounting part, each of the plurality of connecting pieces penetrated in each of the plurality of connection ports by the mounting part thereof, and each of the plurality of connecting pieces standing on a side of the at least one base through at least one of the connecting part and the step part abutted against the at least one base; and at least one auxiliary clip, connecting a bottom of the at least one base to a bottom of the at least one wall, wherein the at least one base comprises a bottom frame, a top frame, and a plurality of support posts connected to the bottom frame and the top frame, the plurality of connection ports are located on the top frame, and the at least one auxiliary clip is connected to the bottom frame.

2. The expandable and varied furniture structure as claimed in claim 1, wherein the plurality of sides formed with the plurality of connection ports are equal in number to the plurality of connecting pieces of the at least one wall.

3. The expandable and varied furniture structure as claimed in claim 1, wherein the top frame comprises a plurality of plates used to form one of the plurality of connecting ports, and the mounting part of each of the plurality of connecting pieces and the connecting part are respectively connected to two opposite faces of one of the plurality of plates.

4. The expandable and varied furniture structure as claimed in claim 1, wherein the at least one wall comprises an opening and a beam located in the opening and provided for disposal of the plurality of connecting pieces thereon.

5. The expandable and varied furniture structure as claimed in claim 4, wherein the beam comprises a plurality of pivot seats respectively assembled with one of the plurality of connecting pieces, and the plurality of pivot seats are located on a surface of the beam in pairs and spaced apart.

6. The expandable and varied furniture structure as claimed in claim 4, wherein the at least one base comprises a plurality of first feet, and the at least one wall comprises a plurality of second feet.

7. The expandable and varied furniture structure as claimed in claim 1, wherein the expandable and varied furniture structure further comprises at least one seat cushion stacked on the at least one base.

8. The expandable and varied furniture structure as claimed in claim 1, wherein the at least one base comprises a plurality of first feet, and the at least one wall comprises a plurality of second feet.

* * * * *